US006033625A

United States Patent [19]

Nagashima et al.

[11] Patent Number: 6,033,625

[45] Date of Patent: Mar. 7, 2000

[54] PARTS OF ELECTRONIC DEVICES MADE OF FERRITIC FREE CUTTING STAINLESS STEEL

[75] Inventors: Tomotaka Nagashima; Michio Okabe, both of Chita, Japan

[73] Assignee: Diado Steel Co., Ltd., Nagoya, Japan

[21] Appl. No.: 09/187,041

[22] Filed: Nov. 6, 1998

[30] Foreign Application Priority Data

Nov. 12, 1997 [JP] Japan ..... 9-310922

[51] Int. Cl.[7] ..... C22C 38/18; C22C 38/60

[52] U.S. Cl. ..... 420/42; 420/41

[58] Field of Search ..... 420/41, 42

[56] References Cited

U.S. PATENT DOCUMENTS

| | | | |
|---|---|---|---|
| 4,270,950 | 6/1981 | Fujiwara et al. | 420/41 |
| 5,496,515 | 3/1996 | Pedarre et al. | 420/42 |

FOREIGN PATENT DOCUMENTS

| | | | |
|---|---|---|---|
| 53-26215 | 3/1978 | Japan | 420/41 |
| 54-21809 | 8/1979 | Japan | 420/41 |
| 55-122857 | 9/1980 | Japan | 420/42 |
| 1137295 | 12/1968 | United Kingdom | 420/42 |

*Primary Examiner*—Deborah Yee

*Attorney, Agent, or Firm*—Vardell & Vardell, PLLC

[57] ABSTRACT

Improved parts of electronic apparatus made of ferritic free cutting steel, which enjoy high precision in size given by good machinability and free from trouble caused by corrosion of metal due to generation of sulfides. The material steel has an alloy composition consisting essentially of, by weight %, C: up to 0.1%, Si: up to 2.0%, Mn: up to 2.0%, Cr: 19–25% and S: 0.20–0.35% and the balance of Fe and impurities. The parts made by machining can be used without being passivated. The steel may contain, further to the above alloy components, one or more from the following groups: 1) Mo: up to 4.0%; 2) one or more of Pb: up to 0.4%, Bi: up to 0.3%, Te: up to 0.3%, Se: up to 0.4% and Ca: up to 0.3%; 3) one or both of B and Mg: 0.001–0.02%; 4) one or both of Cu and Ni: 0.1–4.0%; 5) one or more of Nb, Ta, Ti, V, W and Al: 0.01–0.50%; and 6) O: 0.01–0.04%.

8 Claims, No Drawings

PARTS OF ELECTRONIC DEVICES MADE OF FERRITIC FREE CUTTING STAINLESS STEEL

BACKGROUND OF THE INVENTION

1. Field in the Industry

The present invention concerns parts of electronic devices made of ferritic free cutting stainless steel.

2. Prior Art

The pro of precision parts, for which high accuracy in sizes as well as corrosion resistance are required, includes machining of material ferritic stainless steel such as SUS430 to which 0.2% or more of S is added for the purpose of improving machinability. This kind of ferritic free cutting stainless steel part is made by machining after being treated by passivation for improving corrosion resistance thereof. The passivation is usually carried out by immersing the parts in warmed nitric acid for a predetermined period of time.

Many of the electronic parts contains metals such as Ag, Cu and Al as the components of circuits. These metals tend to be corroded by sulfides such as $H_2S$, which may be in the atmosphere, and the corrosion causes trouble of abnormal working of the electronic apparatus. Such trouble has been experienced in apparatus in which ferritic free cutting stainless steel parts are incorporated. The cause of the trouble is considered to be corrosion by generation of gaseous compounds containing sulfur (usually called "sulfide gases") from the parts of ferritic free cutting stainless steel, which received machining and passivation treatment.

SUMMARY OF THE INVENTION

The object of the present invention is to provide improved parts of electronic apparatus made of ferritic free cutting steel, which enjoy high precision in size given by good machinability and which are free from trouble caused by corrosion of metal due to generation of sulfides.

The parts of electronic apparatus according to the present invention are made of ferritic free cutting stainless steel basically of the alloy composition consisting essentially of, by weight %, C: up to 0.1%, Si: up to 2.0%, Mn: up to 2.0%, Cr: 19–25% and S: 0.20–0.35% and the balance of Fe and impurities.

DETAILED EXPLANATION OF PREFERRED EMBODIMENTS OF THE INVENTION

The free cutting ferritic stainless steel of the invention may contain one or more of the following optional alloy components in addition to those of the above described basic alloy composition.

1) Mo: up to 4.0%;
2) one or more of Pb: up to 0.4%, Bi: up to 0.3%, Te: up to 0.3%, Se: up to 0.4% and Ca: up to 0.3%;
3) one or both of B and Mg (in case of both, in total): 0.001–0.02%;
4) one or both of Cu and Ni (in case of both, in total): 0.1–4.0%;
5) one or more of Nb, Ta, Ti, V, W and Al (in case of both, in total): 0.01–0.50%; and
6) 0: 0.01–0.04%.

The following explains the reason why the alloy composition of the free cutting stainless steel used in the invention is chosen as above. C: up to 0.1%

Although carbon is a representative solid solution strengthening element, a lower content thereof is preferable, because carbon decreases corrosion resistance and normal temperature resilience of the steel. However, if an extremely high carbon content is used the manufacturing costs will be high, and thus, in view of easy refining operation, the upper limit is determined to 0.1%. Si: up to 2.0%

Silicon is a deoxidizing agent and at the same time a solid solution strengthening element. The added amount can be so adjusted to give the required strength to the steel. The upper limit of 2.0% is set because a higher content exceeding this limit lowers hot workability of the steel. Mn: up to 2.0%

Manganese is an element which forms compounds with sulfur and selenium to take an auxiliary role for improving machinability of the steel. Because manganese decreases corrosion resistance, the added amount should be up to 2.0%. The existence of manganese also assists generation of sulfide gases, and in the case where required improvement in corrosion resistance and prevention of sulfide gas generation are desired, a lower content of manganese, say, 0.5% or lower, should be chosen. Cr: 19.0–25.0%

Chromium is essential for ensuring corrosion resistance of the steel. In order that the alloy has sufficient corrosion resistance without passivation treatment, the addition of 19% or higher is necessary. A content higher than 25% heightens costs of the alloy and lowers hot workability. Accordingly, the range of 19–25% is set. S: 0.20–0.35%

Sulfur is a machinability improving element, which is useful for elongating tool lives by forming (Mn, Cr)S in the steel to promote chipping of the cut flakes. To enjoy this effect fully, it is necessary to add sulfur of 0.20% or more. On the other hand, the addition of an amount of sulfur exceeding 0.35% lowers the workability of the steel. Mo: up to 4.0%

Molybdenum improves corrosion resistance, and can be added, when necessary, in a suitable amount. Because too high a content makes the alloy expensive, it is advisable to restrict the amount to be 4.0% or less. Pb: up to 0.4%, Bi: up to 0.3%, Te: up to 0.3%, Se: up to 0.4%, Ca: up to 0.3%

Lead and bismuth are machinability improving elements. They disperse in the steel in the form of the elements and melt by the heat of cutting to lubricate the tool and the cut flakes, and thus to lengthen the tool lives. However, the addition of too much of these elements lowers hot workability, and therefore, the above respective upper limits, 0.4% and 0.3%, are set.

Tellurium in the sulfur- or selenium-containing free cutting steels makes the sulfides and selenides spheroidal, decreases anisotropy of the material strength, and thus improves workability and machinability of the steels. These effects gradually saturate at higher contents, and the upper limit is set to 0.3%.

Selenium is also a machinability improving element, which forms in the steel mainly (Mn, Cr)Se and promotes chipping of the cut flakes to lengthen the tool lives. Addition in an amount exceeding 0.4% lowers hot workability of the steel, and this is the upper limit.

Calcium also improves machinability of the steel. Addition in an amount up to 0.3% is recommended, because the addition of larger amounts does not sigificantly improve machinability due to formation of the corresponding oxide. One or both of B and Mg (in case of both, in total): 0.001–0.02%

Both boron and magnesium improve hot workability of the steel. A content less than 0.001% provides little effect, while a content exceeding 0.02% decreases the hot workability. Thus, the addition is to be in the above range, 0.001–0.02%. One or both of Cu and Ni (in case of both, in total): 0.1–4.0%

Copper and nickel contribute to improvement in corrosion resistance. It is preferable to add one or both of them in a amount of 0.1% or higher, at which amount the effect of addition is assured. One or more of Nb, Ta, Ti, V, W and Al (in case of two or more, in total): 0.01–0.50%

The addition of a suitable amount or amounts of one or more of Nb, Ta, Ti, V, W and Al causes decrease of solid solution of carbon and/or nitrogen due to formation of carbides and/or nitrides, and results in softening of the matrix which improves strength of the steel. Therefore, it is preferable to add one or more of these elements in an amount of 0.01% or higher to obtain the above effect. If, however, the total amount of the addition exceeds 0.50%, strength of the alloy decreases, because of excess solid solution of the element or elements 0: 0.01–0.04%

Oxygen combines with aluminum to form $Al_2O_3$, which will act as cores for formation of sulfides and selenides in the steel. To utilize this effect the oxygen content must be suitable. An oxygen content less than 0.01% is insufficient, while a content exceeding 0.04% causes formation of too much $Al_2O_3$ which is harmful to the machinability.

The present invention provides parts for electronic apparatus made of ferritic free cutting stainless steel, which enjoys merits of good machinability common in this kind of material and ensures high precision in sizes, and further free from troubles of electronic apparatus caused by generation of sulfide gases. In other words the parts for electronic apparatus of the present invention have sufficient corrosion resistance without passivation treatment, and elimination of the passivation treatment removes the cause of sulfide gas generation. In some embodiments of the present invention in which the alloy composition is particularly selected, even if passivation is carried out to obtain high corrosion resistance of the steel, the steel is still free from generation of sulfide gas.

EXAMPLES

Free cutting ferritic stainless steels of the alloy composition shown in TABLE 1 were prepared in a high frequency induction furnace and the molten steels were cast into 50 kg ingots.

These ingots were hot forged to form round rods of diameter 20 mm, which were subjected to heat treatment of heating at 750° C. for 2 hours followed by air cooling. The steel rods were machined to sample plates of 25 mm long, 15 mm wide and 3 mm thick, and both the faces of the plates were polished with #400 emery paper. Some of the sample plates were passivated by immersing in 30%-nitric acid for 1 hour at 50° C.

TABLE 1

| No. | C | Si | Mn | S | Cr | Mo | Pb, Bi, Te Se, Ca | B Mg | Cu Ni | Nb, Ta, Ti V, W, Al | O |
|---|---|---|---|---|---|---|---|---|---|---|---|
| Examples | | | | | | | | | | | |
| 1 | 0.02 | 0.2 | 1.2 | 0.25 | 19.1 | — | — | — | — | — | — |
| 2 | 0.01 | 0.8 | 0.3 | 0.35 | 21.3 | — | — | — | — | — | — |
| 3 | 0.01 | 1.4 | 0.7 | 0.29 | 24.3 | — | — | — | — | — | — |
| 4 | 0.08 | 0.5 | 0.2 | 0.33 | 23.5 | 1.2 | — | — | — | — | — |
| 5 | 0.04 | 1.3 | 0.9 | 0.33 | 23.5 | 1.2 | — | — | — | — | — |
| 6 | 0.03 | 1.1 | 0.3 | 0.32 | 20.3 | 1.0 | Pb 0.25<br>Te 0.02 | — | — | — | — |
| 7 | 0.05 | 0.2 | 0.5 | 0.22 | 24.1 | 1.0 | Bi 0.11<br>Te 0.12<br>Se 0.11 | — | — | — | — |
| 8 | 0.06 | 1.5 | 1.3 | 0.25 | 20.5 | 1.0 | Pb 0.21<br>Ca 0.03 | — | — | — | — |
| 9 | 0.03 | 0.2 | 0.2 | 0.31 | 23.2 | 1.0 | Pb 0.31<br>Bi 0.08<br>Te 0.07 | — | — | — | 0.028 |
| 10 | 0.01 | 1.8 | 0.8 | 0.33 | 23.8 | 2.8 | Bi 0.08<br>Te 0.08<br>Se 0.11 | B 0.011 | — | — | — |
| 11 | 0.08 | 0.3 | 1.1 | 0.28 | 20.8 | 2.8 | Pb 0.25<br>Te 0.11 | — | Cu 0.8<br>Ni 2.2 | — | 0.031 |
| 12 | 0.05 | 1.8 | 1.6 | 0.33 | 19.5 | 1.1 | Pb 0.05<br>Bi 0.03<br>Se 0.03<br>Ca 0.02 | B 0.006 | Ni 0.5<br>Ta 0.2<br>V 0.03<br>Al 0.03 | Nb 0.21 | — |
| 13 | 0.07 | 1.1 | 1.4 | 0.21 | 24.3 | — | Pb 0.03<br>Bi 0.05<br>Te 0.09<br>Se 0.02 | Mg 0.003 | Cu 0.3 | Nb 0.04<br>Ti 0.09<br>W 0.08 | — |
| Control Examples | | | | | | | | | | | |
| 1 | 0.08 | 0.6 | 1.2 | 0.33 | 16.5 | — | — | — | — | — | — |
| 2 | 0.03 | 3.0 | 0.3 | 0.33 | 16.8 | — | — | — | — | — | 0.018 |
| 3 | 0.03 | 0.5 | 1.2 | 0.26 | 17.5 | — | Pb 0.21<br>Te 0.03 | B 0.005 | — | — | — |

The sample plates, both those passivated and not passivated, were subjected to the following tests.

Generation of Sulfide Gases

Each sample plate was placed in a closed vessel together with a silver foil of 10 mm×10 mm and a small amount of water. After standing still for 24 hours at 80° C., the silver foils were observed to determine extent of corrosion (coloring) due to sulfiding of Ag. The results were classified to the following 4 steps.

A: no change in color

B: slight change in color

C: change in color observed

D: remarkable color change

It is considered that, in cases of steps A and B, the steel may cause little trouble when used as the material of practical parts of electronic apparatus.

Corrosion Resistance

The sample plates used for the above test for sulfide gas generation were then used for determination of corrosion resistance by observing occurrence of rust. It is the requisite for suability of the steel as the parts for electronic apparatus that the it does not rust under the testing conditions noted above.

The test results are shown in Table 2. From the data in Table 2 it is concluded that the free cutting ferritic stainless steel of the present invention shows sufficient corrosion resistance even though not passivated, and in turn, no sulfide gas generation is ensured because the steel receives no passivation treatment. Further, the steels in which manganese content is so small as 0.5% or less may not substantially cause generation of sulfide gases even if they are passivated.

TABLE 2

| | No Passivation Treatment | | Passivation Treatment | |
|---|---|---|---|---|
| No. | Gas Releasing | Rust | Gas Releasing | Rust |
| Examples | | | | |
| 1 | B | no rust | C | no rust |
| 2 | A | no rust | B | no rust |
| 3 | B | no rust | C | no rust |
| 4 | A | no rust | A | no rust |
| 5 | B | no rust | B | no rust |
| 6 | A | no rust | A | no rust |
| 7 | A | no rust | A | no rust |
| 8 | B | no rust | B | no rust |
| 9 | A | no rust | A | no rust |
| 10 | B | no rust | B | no rust |
| 11 | B | no rust | C | no rust |
| 12 | B | no rust | B | no rust |
| 13 | B | no rust | B | no rust |

TABLE 2-continued

| | No Passivation Treatment | | Passivation Treatment | |
|---|---|---|---|---|
| No. | Gas Releasing | Rust | Gas Releasing | Rust |
| Control Examples | | | | |
| 1 | B | rusting observed | C | no rust |
| 2 | A | rusting observed | C | no rust |
| 3 | B | rusting observed | C | no rust |

We claim:

1. Parts of electronic apparatus made of ferritic stainless steel of the alloy composition consisting essentially of, by weight %, C: up to 0.1%, Si: up to 2.0%, Mn: up to 2.0%, Cr: 19–25% and S: 0.20–0.35% and the balance of Fe and impurities.

2. Parts of electronic apparatus made of ferritic stainless steel of the alloy composition containing Mo: up to 4.0% in addition to the alloy components according to claim 1.

3. Parts of electronic apparatus made of ferritic stainless steel of the alloy composition containing one or more of Pb: up to 0.4%, Bi: up to 0.3%, Te: up to 0.3%, Se: up to 0.4% and Ca: up to 0.3% in addition to the alloy components according to one of claims 1 and 2.

4. Parts of electronic apparatus made of ferritic stainless steel of the alloy composition containing one or both of B and mg (in case of both, total amount): 0.001–0.02% in addition to the alloy components according to any one of claims 1 to 3.

5. Parts of electronic apparatus made-of ferritic stainless steel of the alloy composition containing one or both of Cu and Ni (in case of both, total amount): 0.1–4.0% in addition to the alloy components according to claim 1.

6. Parts of electronic apparatus made of ferritic stainless steel of the alloy composition containing one or more of Nb, Ta, Ti, V, W and Al (in case of two or more, total amount): 0.01–0.50% in addition to the alloy components according to claim 1.

7. Parts of electronic apparatus made of ferritic stainless steel of the alloy composition containing O: 0.01–0.04% in addition to the alloy components according to claim 1.

8. Parts of electronic apparatus made of the alloy of any one claims 1 to 3 and free of passivation treatment.

* * * * *